US006945297B1

(12) United States Patent
Gonzalez et al.

(10) Patent No.: US 6,945,297 B1
(45) Date of Patent: Sep. 20, 2005

(54) APPARATUS FOR FOLDING ADHESIVE TAPE

(76) Inventors: Greg Gonzalez, 785 La Paloma Way, Gilroy, CA (US) 95020; Tina M. Gonzalez, 785 La Paloma Way, Gilroy, CA (US) 95020

( * ) Notice: Subject to any disclaimer, the term of this patent is extended or adjusted under 35 U.S.C. 154(b) by 394 days.

(21) Appl. No.: 10/388,558

(22) Filed: Mar. 17, 2003

(51) Int. Cl.[7] ..... B32B 31/00
(52) U.S. Cl. ..... 156/463; 156/465; 156/577
(58) Field of Search ..... 156/227, 463, 156/465, 574, 391, 579, 411, 577; 2/274, 2/244; 493/438, 439, 424, 434, 443, 455; 206/456, 408

(56) References Cited

U.S. PATENT DOCUMENTS 253,428 A * 2/1882 Ridgway ..... 156/463
2,048,994 A 7/1936 Clinton
2,367,417 A 1/1945 Milem
3,015,455 A 1/1962 Blackman
4,700,906 A 10/1987 Lapadakis
4,875,634 A 10/1989 Lapadakis
4,998,682 A 3/1991 Malone
5,678,689 A 10/1997 Clark et al.
2004/0238109 A1 * 12/2004 Gonzalez ..... 156/227

* cited by examiner

*Primary Examiner*—Blaine Copenheaver
(74) *Attorney, Agent, or Firm*—Donald R. Schoonover

(57) ABSTRACT

Tape, such as masking tape, that is used during the painting of automobiles to mark the boundaries of various areas on the vehicle, is fed from a device that automatically folds the edges of the tape over onto the remaining portion of the tape. The tape thus has areas adjacent to the edges that do not adhere to the substrate and thus permits paint to move under the tape at such defined areas wherein no tape line will be produced during the painting process.

1 Claim, 1 Drawing Sheet

APPARATUS FOR FOLDING ADHESIVE TAPE

BACKGROUND OF THE INVENTION

1. Field of the Invention

The present invention relates to the general art of masking tape, and to the particular field of modifying masking tape to a particular application.

2. Discussion of the Related Art

Painting and detailing of vehicles often requires that a line or edge be defined by the paint. This often is achieved by covering a portion of the substrate with tape so the edge of the tape defines an edge of the paint. However, in some instances, a sharp edge is not desired. Examples of such situations include door jambs, under a hood, two-toning, spot repairs and the like.

In such instances, masking tape is not as efficient as possible. A problem with using masking tape to define such boundaries is that the tape, itself, will define a paint edge.

Therefore, there is a need for a means and a method for customizing masking tape to avoid defining a paint edge when masking tape is used in painting of vehicles and the like.

Of course, the masking tape can be customized by hand. However, hand customizing of such tape may be too time consuming to be practical. Therefore, there is a need for a means and a method for automatically customizing masking tape to avoid defining a paint edge when masking tape is used in painting of vehicles and the like.

PRINCIPAL OBJECTS OF THE INVENTION

It is a main object of the present invention to provide a means and a method for customizing masking tape to avoid defining a paint edge when masking tape is used in painting of vehicles and the like.

It is another object of the present invention to provide a need for a means and a method for automatically customizing masking tape to avoid defining a paint edge when masking tape is used in painting of vehicles and the like.

SUMMARY OF THE INVENTION

These, and other, objects are achieved by a device for handling masking tape which comprises a base having a top wall, an opening defined in the top wall, and a tape-engaging surface on the top wall adjacent to the opening; a tape roll-supporting element on the base; a first tape-folding element mounted on the top wall of the base near the tape roll-supporting element, the first tape-folding element including a base element and a tape edge-engaging element on the base element and which is spaced apart from the top wall of the base by a first distance; a second tape-folding element mounted on the top wall of the base adjacent to the first tape-folding element; a third tape-folding element mounted on the top wall of the base adjacent to the opening defined in the top wall of the base, the third tape-folding element including a base element and a tape edge-engaging element on the base element of the third tape folding-element and which is spaced apart from the top wall of the base by a second distance, with the second distance being smaller than the first distance.

The objects are also achieved by a process for folding tape which comprises supporting a roll of tape so the tape is oriented in a vertical plane; feeding the tape from the roll; guiding the tape around a first tape-folding roller and engaging one edge of the tape being fed around the first tape-folding roller and folding the one edge over the remainder of the tape and defining a first folded tape which is oriented in a vertical plane; reorienting the first folded tape to be in a horizontal plane; pressing the one edge against the remainder of the tape and adhering the one edge to the remainder of the tape and defining a first folded and adhered tape; reorienting the first folded and adhered tape into a vertical plane; guiding the tape around a second tape-folding roller and engaging a second edge of the tape being fed around the second tape-folding roller and folding the second edge over the remainder of the tape and defining a second folded tape which is oriented in a vertical plane; reorienting the second folded tape into a horizontal plane; and pressing the second edge against the remainder of the tape and adhering the second edge to the remainder of the tape and defining a second folded and adhered tape.

The edges of the tape are automatically folded over so the adhesive on the tape will bond the folded-over edges to the body of the tape. This covers the adhesive on the folded-over edges and defines a non-adhesive portion adjacent to each edge of the customized tape. When the customized tape is adhered to a substrate, the edges of the customized tape will not bond to the substrate thus leaving an area uncovered adjacent to the body of the customized tape. When paint is applied, some of the paint will move beneath the non-bonded edges thereby producing a desired effect without having to hand modify the tape. The form of the invention discussed in this disclosure folds approximately one-eighth inch on each edge of a tape over onto the body of the tape so that a total of one-fourth inch is folded over. For example, if the tape is three-fourths inch wide, a one-eighth inch border is formed adjacent to each edge, leaving one-half inch of tape that will adhere to the substrate.

BRIEF DESCRIPTION OF THE DRAWING FIGURES

DETAILED DESCRIPTION OF THE PREFERRED EMBODIMENT

Figure 2:
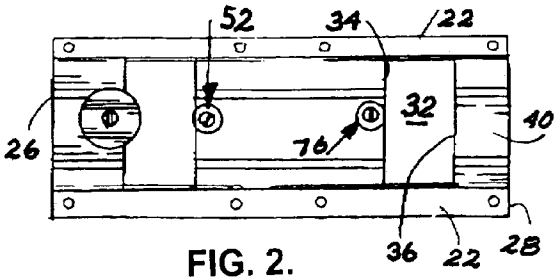
FIG. 2 is a bottom plan view of the device for handling tape embodying the present invention.
Figure 3:
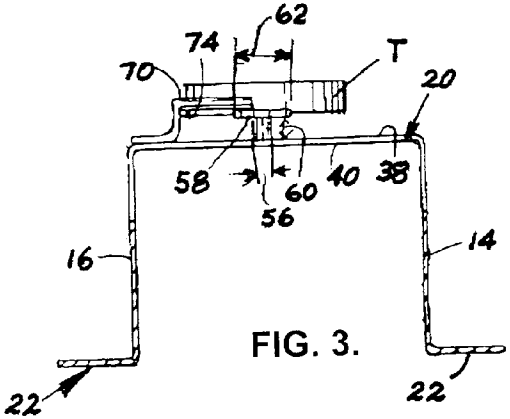
FIG. 3 is an end view of the device for handling tape embodying the present invention as seen on line 3—3 of FIG. 1.

Other objects, features and advantages of the invention will become apparent from a consideration of the following detailed description and the accompanying drawings.

Referring to the figures, it can be seen that the present invention is embodied in a device 10 for handling tape. Device 10 will dispense tape T in a manner that automatically folds the tape edges over the body of the tape in a manner that defines edges that do not adhere to a substrate, such as an automobile being painted. Device 10 thereby eliminates a paint line, which is desirable in some instances.

Device 10 comprises a base 12 having a first side wall 14, a second side wall 16, a transverse axis 18 extending between the first side wall 14 and the second side wall 16, a top wall 20, a bottom wall 22, a height axis 24 extending between the top wall 20 and the bottom wall 22, a first end 26, a second end 28, and a longitudinal axis 30 extending between the first end 26 and the second end 28. A first opening 32 is defined in the top wall 20 near second end 28. The first opening 32 includes a first edge 34 on the top wall 20 and a second edge 36 on the top wall 20 with the second edge 36 being spaced apart from the first edge 34 in the direction of the longitudinal axis 30 toward the second end 28 of the base 12. The top wall 20 further includes an outside surface 38 and an inside surface 40.

A tape roll support element 50 is mounted on the top wall 20 of the base 12 near the first end 26 of the base 12 and supports a roll of tape T with the tape oriented in a vertical plane with the first and second side walls 14, 16 also being oriented in a vertical plane and the top wall 20 being oriented in a horizontal plane.

A first tape-folding roller 52 is mounted on the top wall 20 of the base 12 near the tape roll support element 50 and is spaced from the tape roll support element 50 in the direction of the longitudinal axis 30 of the base 12 toward the second end 28 of the base 12 and is spaced from the tape roll support element 50 in the direction of the height axis 24 toward bottom wall 22 of the base 12. First tape-folding roller 52 includes a base element 54 mounted on the top wall 20 of the base 12. Base element 54 of the first tape-folding roller 52 has a radial dimension 56. The first tape-folding roller 52 further includes a tape-engaging head element 58 mounted on the base element of the first tape-folding roller 52. The tape-engaging head element 58 is spaced apart from the top wall 20 of the base 12 by a first distance 60 and has a radial dimension 62 which is greater than the radial dimension 56 of the base 54 of the first tape-folding roller 52. As will be understood from the teaching of the present disclosure, the first distance 60 is less than a width dimension W of tape T. Since radial dimension 56 is less than radial dimension 62, and since tape T is positioned above the first tape-folding roller 52, as tape T moves around first tape-folding roller 52, the edge $E_1$ of tape T is pushed away from a plane containing the remainder of tape T. Tape T moves in direction F off of the tape roll towards second end 28 of the base 12. Downstream direction DF and upstream direction UF are taken with reference to direction F. In the direction of tape movement, edge $E_1$ will be folded over the remaining portion of the tape in direction $O_1$. Tape T is oriented so that adhesive A is located on side $A_1$ of the tape. Thus, edge $E_1$ is folded over the remaining portion of the tape so that adhesive A on edge $E_1$ contacts adhesive A on side $A_1$ on the remaining portion of the tape. Side $A_2$ of the tape is free of adhesive. Thus, a portion of the folded tape adjacent to edge $E_1$ will be free of adhesive. In one form of the invention, this portion is one-eighth of an inch with the overall width dimension W of the tape being three-fourths of an inch. Other widths can also be set by adjusting the first distance 60.

A tape-folding element 70 is mounted on the top wall 20 of the base 12 near the first tape-folding roller 52 and is spaced apart from the first tape-folding roller 52 in the direction of the longitudinal axis 30 of the base 12 towards the second end 28 of the base 12. Tape-folding element 70 includes a body 72 which extends in the direction of the transverse axis 18 of the base 12. Body 72 of tape-folding element 70 includes a tape-engaging surface 74 located adjacent to the outside surface 38 of the top wall 20 of the base 12. Tape-folding element 70 includes a V-shaped portion 75 which defines an entrance portion EA and an exit portion OA. Tape entering the area adjacent to the entrance portion will be smoothly forced against the top wall 20 of the base 12 as the tape passes beneath the V-shaped portion 75 and then smoothly exits the tape-folding element 70 via the area adjacent to the exit portion OA.

After leaving the first tape-folding roller 52, edge $E_1$ of the tape is pushed over to overlap the remainder of the tape. The tape then moves beneath tape-folding element 70 and the folded-over edge is pressed against the remaining body of the tape. This causes the adhesive on the folded-over edge to adhere to the adhesive on the remainder of the body of the tape. The V-shaped portion 75 of the tape-folding element 70 is located sufficiently close to the top wall 20 of the base 12 to permit the tape to move past the V-shaped portion 75 yet have the folded-over edge pressed against the rest of the tape by the action of the V-shaped portion 75 and the top wall 20 of the base 12.

A second tape-folding roller 76 is mounted on the top wall 20 of the base 12 near first edge 34 of the first opening 32 defined in the top wall 20 of the base 12 and is spaced apart from the first edge 34 of the first opening 32 in the direction of the longitudinal axis 30 of the base 12 toward first end 26 of the base 12. Second tape-folding roller 76 includes a base element 78 mounted on the top wall 20 of the base 12. Base element 78 of the second tape-folding roller 76 has a radial dimension 80. The second tape-folding roller 76 further includes a tape-engaging head 82 mounted on the base element 78 of the second tape-folding roller 76. The tape-engaging head 82 of the second tape-folding roller 76 is spaced apart from the top wall 20 of the base 12 by a second distance 84 and has a radial dimension 88 which is greater than radial dimension 80 of the base element 78 of the second tape-folding roller 76.

The operation and function of second tape-folding roller 76 is similar to the operation and function of first tape-folding roller 52 as discussed above. The tape exiting tape-folding element 70 is moving in a horizontal plane. The tape is re-oriented into a vertical plane to pass around second tape-folding roller 76. Edge $E_1$ abuts tape-engaging head 82 and the other edge, edge $E_2$, abuts base element 78 of the second tape-folding roller 76. Since edge $E_1$ is a double thickness, the tape folds about edge $E_2$ as that edge moves against the outside surface 38 of the base 12 and the tape engages tape-engaging head 82. This forces edge $E_2$ to fold upwardly toward the remaining portion of the tape in direction $O_2$. As discussed above, adhesive is located on side $A_2$ of the tape, and thus adhesive on edge $E_2$ adheres to adhesive on the remaining portion of the tape.

Second distance 84 is less than first distance 60. This relationship accounts for the smaller size of tape associated with second tape-folding roller 76 than with first tape-folding roller 52 since the tape associated with second tape-folding roller 76 has already been folded over by first tape-folding roller 52 and tape-folding element 70. Distance 84 is set to fold the tape and define a folded edge on the tape, which is the same dimension as the folded edge $E_1$. Thus, in one form of the invention, distance 84 is set to define an edge $E_2$ that is one-eighth of an inch. Thus, in the example being discussed, a three-fourths inch tape has been folded into edges $E_1$ and $E_2$ that are each one-eighth of an inch, thereby leaving one-half inch of tape that can be adhered to a substrate with two boundary edges of one-eighth of an inch each.

After exiting the second tape-folding roller 76, the tape moves over first edge 34 adjacent to opening 32 and then under second edge 36 located adjacent to opening 32 and is pressed against inside surface 40 of the base 12 adjacent to second edge 36 of the opening 32. This pressing serves the same function for edge $E_2$ as tape-folding element 70 does for edge $E_1$. That is, the folded-over edge is pressed against the remainder of the tape body to cause the adhesive on the folded-over edge to adhere to the adhesive on the remainder of the body. The final form of the folded tape is indicated in FIG. 4 as FT.

Figure 4:
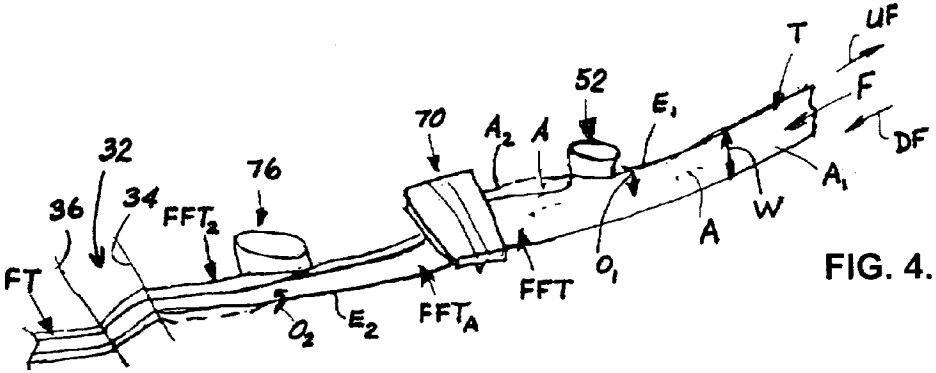
FIG. 4 shows how tape is customized by folding the edges over onto the body of the tape being customized to define non-adhesive areas adjacent to each edge.
Figure 1:
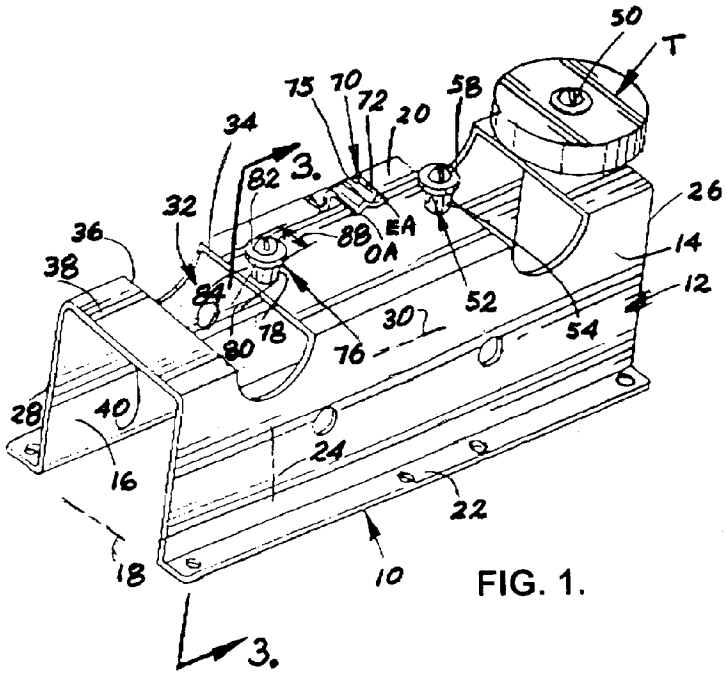
FIG. 1 is a perspective view showing the device for handling tape embodying the present invention.

As can also be understood from the foregoing disclosure, and by reference to FIG. 4, the invention 10 is also embodied in a process for folding tape T. The process comprises supporting a roll of tape T so the tape is oriented in a vertical plane; feeding the tape from the roll in a direction F; guiding the tape around a first tape-folding roller 52 and engaging one edge $E_1$ of the tape being fed around the first tape-folding roller 52 and folding the one edge over the remainder of the tape and defining a first folded tape FFT which is oriented in a vertical plane; reorienting the first folded tape to be in a horizontal plane; pressing edge $E_1$ against the remainder of the tape and adhering the one edge to the remainder of the tape and defining a first folded and adhered tape $FFT_A$; reorienting the first folded and adhered tape into a vertical plane; guiding the tape around second tape-folding roller 76 and engaging a second edge $E_2$ of the tape being fed around the second tape-folding roller 76 and folding the second edge over the remainder of the tape and defining a second folded tape $FFT_2$ which is oriented in a vertical plane; reorienting the second folded tape into a horizontal plane; and pressing second edge $E_2$ against the remainder of the tape and adhering the second edge to the remainder of the tape and defining a second folded and adhered tape FT. Tape FT is oriented in a horizontal plane.

It is understood that while certain forms of the present invention have been illustrated and described herein, it is not to be limited to the specific forms or arrangements of parts described and shown.

What is claimed and desired to be covered by Letters Patent is:

1. A device for handling tape comprising:

a) a base having a first side wall, a second side wall, a transverse axis extending between the first side wall and the second side wall, a top wall, a bottom wall, a height axis extending between the top wall and the bottom wall, a first end, a second end, a longitudinal axis extending between the first end and the second end, a first opening defined in the top wall near the second end, the first opening including a first edge on the top wall and a second edge on the top wall with the second edge being spaced apart from the first edge in the direction of the longitudinal axis toward the second end of said base, the top wall including an outside surface and an inside surface;

b) a tape roll support element mounted on the top wall of said base near the first end of said base;

c) a first tape-folding roller mounted on the top wall of said base near said tape roll support element and spaced from said tape roll support element in the direction of the longitudinal axis of said base toward the second end of said base, said first tape-folding roller being spaced apart from said tape roll support element in the direction of the height axis of said base toward the bottom wall of said base, said first tape-folding roller including a base element mounted on the top wall of said base, the base element of the first tape-folding roller having a radial dimension, said first tape-folding roller further including a tape-engaging head element mounted on the base element of said first tape-folding roller, the tape-engaging head element being spaced apart from the top wall of said base by a first distance and having a radial dimension which is greater than the radial dimension of the base of said first tape-folding roller;

d) a tape-folding element mounted on the top wall of said base near said first tape-folding roller and spaced apart from said first tape-folding roller in the direction of the longitudinal axis of said base towards the second end of said base, said tape-folding element including a body extending in the direction of the transverse axis of said base, the body of said tape-folding element including a tape-engaging surface located adjacent to the outside surface of the top wall of said base, said tape- folding element including a V-shaped portion, an entrance portion adjacent to the V-shaped portion and an exit portion adjacent to the V-shaped portion, the V-shaped portion being located closer to the top wall of said base than the entrance portion and the exit portion;

e) a second tape-folding roller mounted on the top wall of said base near the first edge of the first opening defined in the top wall of said base and spaced apart from the first edge of the first opening in the direction of the longitudinal axis of said base toward the first end of said base, said second tape-folding roller including a base element mounted on the top wall of said base, the base element of said second tape-folding roller having a radial dimension, said second tape-folding roller further including a tape-engaging head mounted on the base element of said second tape-folding roller, the tape-engaging head of said second tape-folding roller being spaced apart from the top wall of said base by a second distance and having a radial dimension which is greater than the radial dimension of the base element of said second tape-folding roller, the second distance being less than the first distance.

* * * * *